US011603619B2

(12) United States Patent
Patre et al.

(10) Patent No.: US 11,603,619 B2
(45) Date of Patent: Mar. 14, 2023

(54) DETACHABLE WASH BASKET FOR A WASHER APPLIANCE

(71) Applicant: Haier US Appliance Solutions, Inc., Wilmington, DE (US)

(72) Inventors: Sarang Patre, Hyderabad (IN); Ansuraj Seenivasan, Hyderabad (IN); Susheel Kumar Panda, Hyderabad (IN); Kalyana Mallavarapu, Hyderabad (IN); Aparna Vajja, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 51 days.

(21) Appl. No.: 17/117,875

(22) Filed: Dec. 10, 2020

(65) Prior Publication Data

US 2022/0186420 A1 Jun. 16, 2022

(51) Int. Cl.

| | |
|---|---|
| ***D06F 37/16*** | (2006.01) |
| ***D06F 33/34*** | (2020.01) |
| ***D06F 39/08*** | (2006.01) |
| *D06F 105/02* | (2020.01) |

(52) U.S. Cl.

CPC ..... *D06F 37/16* (2013.01); *D06F 33/34* (2020.02); *D06F 39/088* (2013.01); *D06F 2105/02* (2020.02)

(58) Field of Classification Search

CPC ..... D06F 37/16; D06F 29/00; D06F 31/00; D06F 39/083

See application file for complete search history.

(56) References Cited

U.S. PATENT DOCUMENTS

| | | | | |
|---|---|---|---|---|
| 3,481,162 | A * | 12/1969 | Ziegler | D06F 13/00 68/4 |
| 4,637,230 | A * | 1/1987 | Roberts | D06F 37/12 68/4 |
| 7,401,479 | B2 | 7/2008 | Fields | |
| 9,745,682 | B2 | 8/2017 | Park et al. | |
| 10,718,079 | B2 | 7/2020 | Ramasco et al. | |
| 2018/0313014 | A1 | 11/2018 | Kim et al. | |
| 2019/0017208 | A1 | 1/2019 | Marangoni et al. | |
| 2019/0017215 | A1* | 1/2019 | Gonzaga | D06F 39/02 |
| 2019/0177899 | A1* | 6/2019 | Suh | D06F 37/245 |

* cited by examiner

*Primary Examiner* — Joseph L. Perrin
*Assistant Examiner* — Kevin G Lee
(74) *Attorney, Agent, or Firm* — Dority & Manning, P.A.

(57) ABSTRACT

A detachable or removable wash basket having a wash compartment for the receipt of articles for washing separately from a larger wash drum of the appliance. The wash basket is received upon an agitator of the washing appliance and includes a valve for draining wash fluid from the wash compartment. A lid can provide a sloped surface for delivery of water into the wash compartment and may be partially covered by a water retaining plate to prevent the flow of fluid from the wash compartment during a cleaning cycle.

18 Claims, 11 Drawing Sheets

DETACHABLE WASH BASKET FOR A WASHER APPLIANCE

FIELD OF THE INVENTION

The subject matter of the present disclosure relates generally to a detachable wash basket for a washer appliance.

BACKGROUND OF THE INVENTION

Washing appliances (also referred to as "washing machines") typically include a single drum or basket for receipt of articles to be washed. While the appliance may have several different cycle types or modes of operation, typically all of the articles placed in the drum will be subjected to the same conditions throughout the user-selected cycle. For example, if the user selects a cleaning cycle that utilizes hot water for a wash operation and cold water for a rinse operation, all of the articles (e.g., clothing) will be subjected to basically the same temperatures as well as the same level of agitation and spinning during the cycle.

The cycle type selected can depend on the type of articles, the amount the articles are soiled or stained, and other variables. Based on such, users may divide articles to be washed into groups based on the cycles available from the washing appliance and characteristics of the articles. One group may contain articles best suited for a hot wash/cold rinse cleaning cycle whereas another group may contain articles best treated by a cold wash/cold rinse cleaning cycle. Other desired differences in the cleaning cycles may be selected and require categorization of the articles.

Even if different types of wash and rinse cycles are not required, there may be other reasons the articles must be separated into different groups. For example, articles to be cleaned may include darker clothing that might be susceptible to "bleeding" whereby dye or colorants can diffuse into the fluid of the wash and rinse operations and undesirably affect the color of other clothing. This can be particularly troublesome if lighter clothing is present in the load. Also, some of the articles may be constructed from fabrics that are more delicate than others and require specialized handling.

The use of separate loads for treatment of the articles to be cleaned can be inconvenient and inefficient. Typically, the drum of a washing machine has a maximum capacity for the amount of articles that can be cleaned during a single cycle. However, a particular load may not require all of the washing machine's capacity. Additionally, for situations as previously mentioned where a user may need to wash multiple loads of articles separately from each other, operating the washing machine in successive cycles for each load is time consuming and may be inefficient—particularly when one or none of the loads require the entire capacity of the washing machine.

Accordingly, a washing machine that can separately clean more than one load of articles during a cycle would be beneficial. A washing machine that can also clean smaller loads without using the entire capacity of the wash drum would also be desirable.

BRIEF DESCRIPTION OF THE INVENTION

Additional aspects and advantages of the invention will be set forth in part in the following description, or may be apparent from the description, or may be learned through practice of the invention.

In one exemplary embodiment, the present invention provides a washing appliance that includes a cabinet and a wash tub positioned in the cabinet and defining a wash chamber. A wash drum is rotatably mounted within the wash chamber and is configured for receiving articles for washing. An agitator may be rotatably mounted within the wash drum and extending into the wash chamber. The agitator may define an interior fluid channel for the flow of fluid towards a bottom of the wash tub. A wash basket assembly is provided that may include a wash basket removably positioned upon the agitator and defining a wash compartment configured for receiving articles for washing. The wash basket may define a drain connectable with the interior fluid channel of the agitator for draining fluid from the wash basket. A valve may provide for selectively controlling the flow of water from the wash compartment through the drain of the wash basket and into the interior fluid channel of the agitator. A lid can be removably positioned on the wash basket and configured for enclosing the wash compartment, the lid defining at least one opening for passage of fluid into the wash compartment of the wash basket.

In another exemplary embodiment, the present invention provides a wash basket assembly for a washing appliance having an agitator and a controller. The wash basket assembly includes a wash basket for removably positioning upon the agitator. The wash basket defines a wash compartment configured for receiving articles for washing. The wash basket defines a drain for allowing fluid to flow out of the wash basket. A valve can allow for selectively controlling the flow of water from the wash compartment of the agitator through the drain and into the interior fluid channel of the agitator. A lid can be removably positioned on the wash basket and configured for enclosing the wash compartment with the lid defining at least one opening for passage of fluid into the wash compartment of the wash basket.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
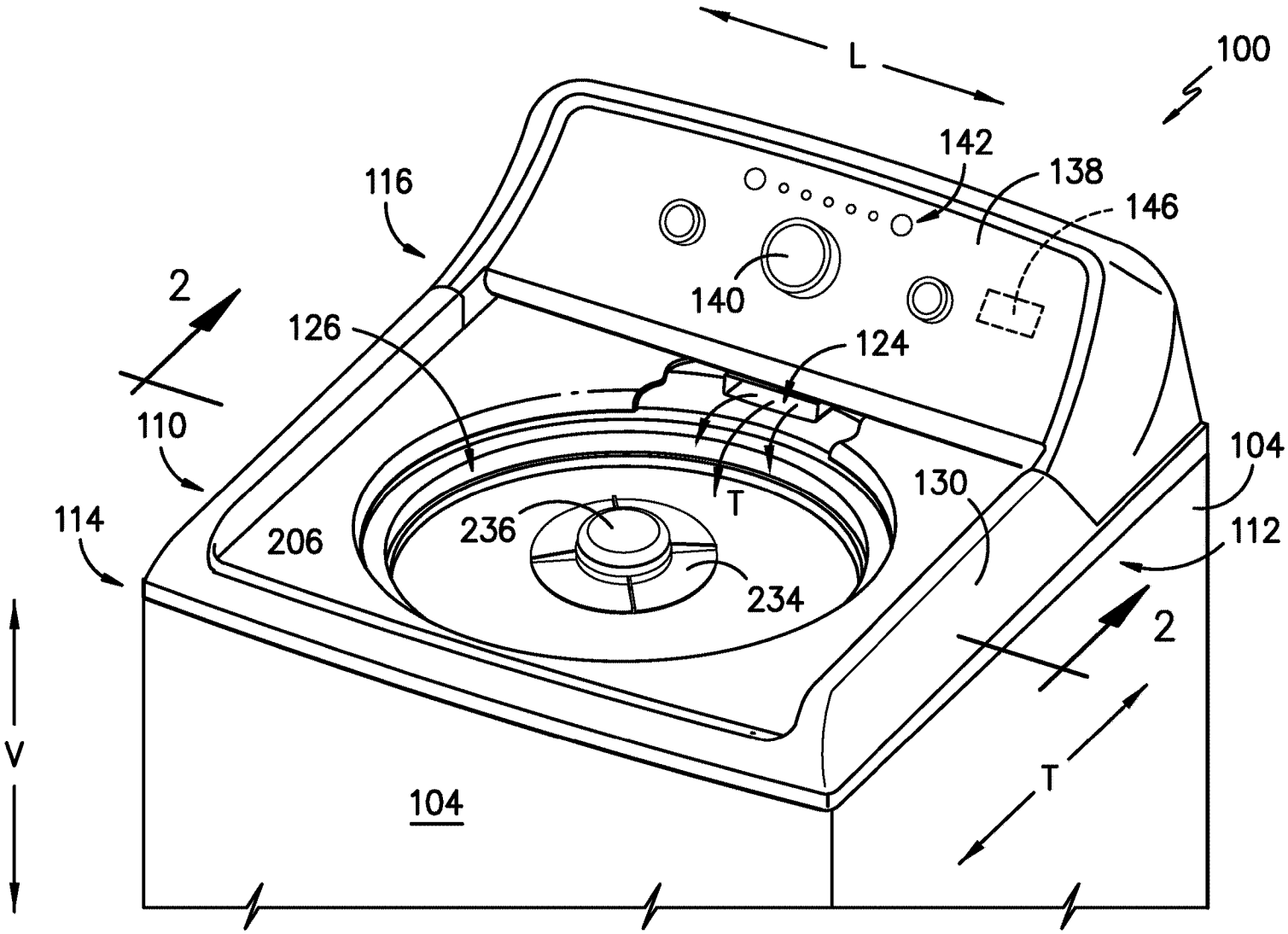
FIG. 1 provides a partial perspective view of an exemplary embodiment of a washing machine of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
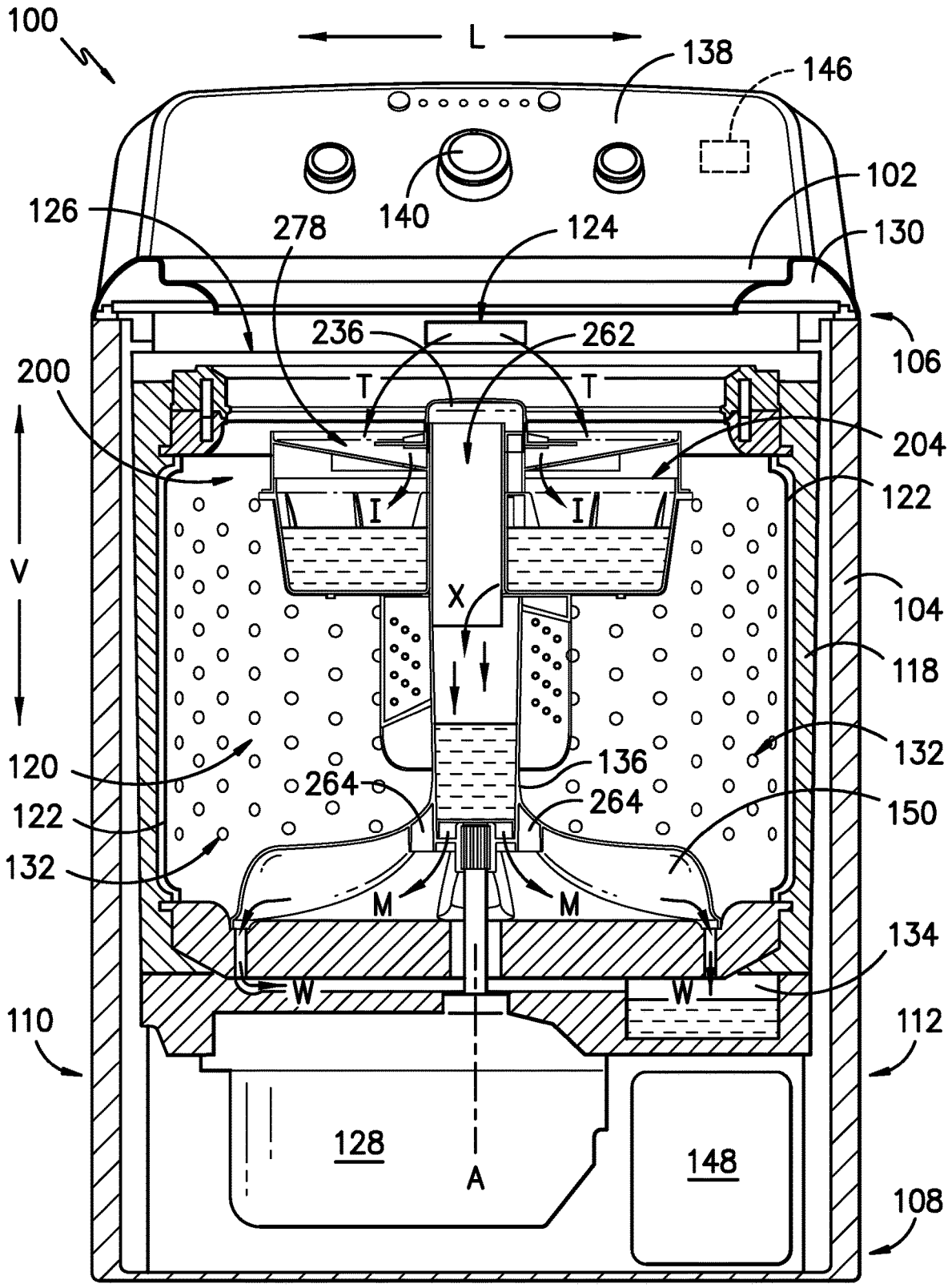
FIG. 2 provides a cross-sectional view of the exemplary washing machine of FIG. 1.

FIGS. 1 and 2 illustrate an exemplary embodiment of a vertical axis washing appliance 100 of the present invention, which is also sometimes referred to as a top loading or vertical axis washing machine. In FIG. 1, a door 102 (shown in FIG. 2) has been removed for purposes of illustrating other features of the invention. Washing machine appliance 100 has a cabinet 104 that extends between a top portion 106 and a bottom portion 108 along the vertical direction V, between a first side (left) 110 and a second side (right) 112 along the lateral direction L, and between a front 114 and a rear 116 along the transverse direction T.

As best shown in FIG. 2, a wash tub 118 is positioned within cabinet 102, defines a wash chamber 120, and is generally configured for retaining wash fluids during an operating cycle. A wash drum 122 is rotatably mounted within wash chamber 120 of wash tub 118. Washing machine appliance 100 further includes a dispenser 124 for dispensing wash fluid into wash tub 118. As will be further described, wash dispenser 124 may direct fluid onto the lid 206 of a wash basket assembly 200 as depicted in FIG. 1. In addition, appliance 100 may include one or more additional dispensers for directing fluid into wash tub 118 and each dispenser may be separately controlled by one or more valves controlling flow to each dispenser independently of the others. The term "wash fluid" refers to a liquid used for washing and/or rinsing articles during an operating cycle and may include any combination of water, detergent, fabric softener, bleach, and other wash additives or treatments. As used herein, the term "cleaning cycle" includes a wash cycle, rinse cycle, spin cycle, or combinations thereof.

Wash drum 122 and cabinet 104 generally define an opening 126 (accessible through door 102) for receipt of articles for washing. Wash basket 122 rotates about an axis of rotation A-A (FIGS. 2 and 3) powered by motor assembly 128. According to the illustrated embodiment, the axis of rotation A-A is substantially parallel to the vertical direction V. As used herein, terms of approximation, such as "approximately," "substantially," or "about," refer to being within a ten percent margin of error.

As illustrated, cabinet 104 of washing machine appliance 100 has a top panel 130. Top panel 130 defines an opening (FIG. 1) that coincides with opening 126 of wash basket 118 to permit a user access to wash drum 122. Door 102 is rotatably mounted to top panel 130 to permit selective access to opening 126. In particular, door 102 selectively rotates between a closed position and an open position. In the closed position, door 102 inhibits access to wash drum 122. Conversely, in the open position, a user can access wash drum 118. Although door 102 is illustrated as mounted to top panel 130, door 102 may alternatively be mounted to cabinet 104 or any other suitable support.

As best shown in FIG. 2, wash drum 122 further defines a plurality of perforations 132 to facilitate fluid communication between an interior of wash drum 122 and wash tub 118. In this regard, wash drum 122 is spaced apart from wash tub 118 to define a space for wash fluid to escape wash chamber 120. During a spin cycle, wash fluid within articles being washed (e.g., clothing) and within wash chamber 120 is urged through perforations 132 wherein it may collect in a sump 134 defined by wash tub 118. Washing machine appliance 100 further includes a pump assembly 148 (FIG. 2) that is located beneath wash tub 118 and wash drum 122 for gravity assisted flow when draining wash tub 118.

An impeller or agitator 136 (FIGS. 2 and 3), such as a vane agitator, impeller, auger, oscillatory basket mechanism, or some combination thereof is rotatably mounted within wash drum 122 to impart an oscillatory motion to articles and liquid in wash drum 122. More specifically, agitator 136 extends into wash drum 122 and assists agitation of articles disposed within wash drum 122 and wash basket assembly 200 (as will be later described) during operation of washing appliance 100, e.g., to facilitate improved cleaning. In different embodiments, agitator element 136 includes a single action element (i.e., oscillatory only), a double action element (oscillatory movement at one end, single direction rotation at the other end) or a triple action element (oscillatory movement plus single direction rotation at one end, single direction rotation at the other end). Agitator 136 and wash drum 122 are oriented to rotate about axis of rotation A-A (which is substantially parallel to vertical direction V). For this exemplary embodiment, agitator 136 is equipped with radial vanes 150 and helical vane 152 that assist in imparting movement to articles during operation of appliance 100.

As stated, washing machine appliance 100 includes a motor assembly 128 in mechanical communication with wash drum 122 to selectively rotate wash drum 122 (e.g., during a wash cycle or a rinse cycle of washing machine appliance 100). In addition, motor assembly 128 may also be in mechanical communication with agitator 136. In this manner, motor assembly 128 may be configured for selectively and independently rotating or oscillating wash drum 122 and/or agitator element 136 during various operating cycles of washing machine appliance 100.

Figure 3:
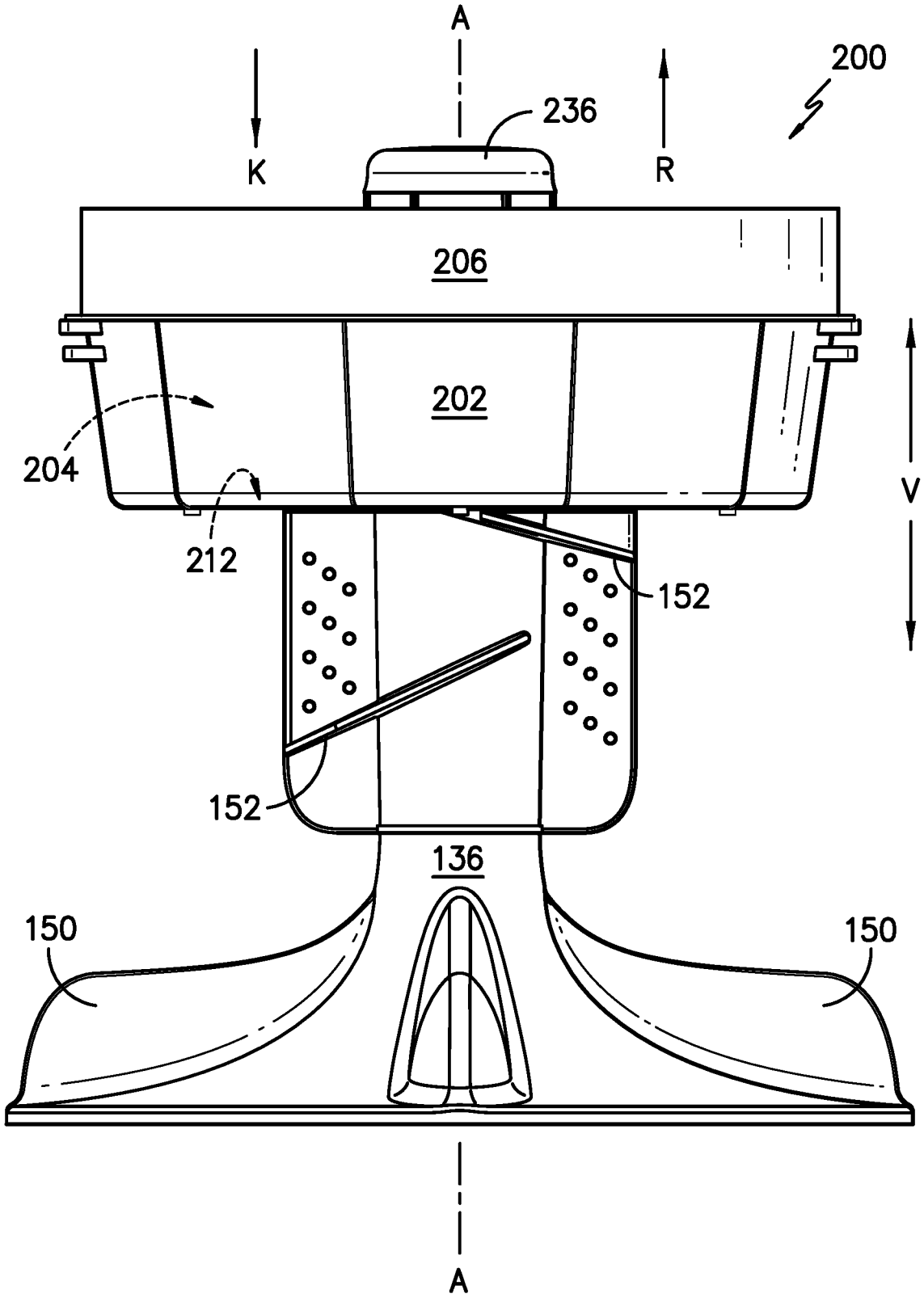
FIG. 3 provides an elevation view of an exemplary agitator and wash basket assembly of the present invention.

Referring still to FIGS. 1 through 3, a control panel 138 with at least one input selector 140 (FIGS. 1 and 2) extends from top panel 130. Control panel 138 and input selector 140 collectively form a user interface input for operator selection of machine cycles and features of washing appliance 100. A display 142 of control panel 138 indicates selected features, operation mode, a countdown timer, and/or other items of interest to appliance users regarding operation.

Operation of washing machine appliance 100 is controlled by at least one controller or processing device 146 that is operatively coupled to control panel 138 for user manipulation to select washing machine cycles and features. In response to user manipulation of control panel 138, controller 146 operates the various components of washing machine appliance 100 to execute selected machine cycles and features. According to an exemplary embodiment, controller 146 may include a memory and microprocessor, such as a general or special purpose microprocessor operable to execute programming instructions or micro-control code associated with methods described herein. Alternatively, controller 146 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 138 and other components of washing machine appliance 100 may be in communication with controller 146 via one or more signal lines or shared communication busses.

During operation of washing machine appliance 100, laundry items are loaded into wash drum 122 through opening 126, and washing operation is initiated through operator manipulation of input selector 140. Water, detergent and/or other fluid additives can be added to wash tub 118 and wash drum 122 through dispenser 124 and/or other dispensers as well depending upon whether appliance 100 is being operated with wash basket assembly 200. Controller 146 can operate one or more valves of washing appliance 100 to provide for filling wash tub 118 and wash drum 122 to the appropriate level for the amount of articles being washed and/or rinsed. By way of example for a wash mode, once wash drum 122 is properly filled with fluid, the contents of wash drum 122 can be agitated (e.g., with agitator 136 as discussed previously) for washing of laundry items in wash drum 122. The specific operation of wash appliance 100 by controller 146 will depend on various inputs including the cycle and other settings that may be selected by the user, the amount of article placed in wash chamber 120, and other variables as will be understood by one of skill in the art using the teachings disclosed herein.

By way of continuing example, after wash tub 118 is filled and the agitation phase of the wash cycle is completed, wash tub 118 and drum 122 can be drained, e.g., by drain pump assembly 148. Laundry articles can then be rinsed by again adding fluid to wash drum 122 and tub 118 again depending on the specifics of the cleaning cycle selected by a user. The impeller or agitation element 136 may also provide agitation within wash drum 1224. One or more spin cycles may also be used as part of the cleaning process. In particular, a spin cycle may be applied after the wash cycle and/or after the rinse cycle in order to wring wash fluid from the articles being washed. During a spin cycle, wash drum 122 is rotated at relatively high speeds to help wring fluid from the laundry articles through perforations 132. After articles disposed in wash drum 122 are cleaned and/or washed, the user can remove the articles from wash drum 122, e.g., by reaching into wash drum 122 through opening 126.

Figure 4:
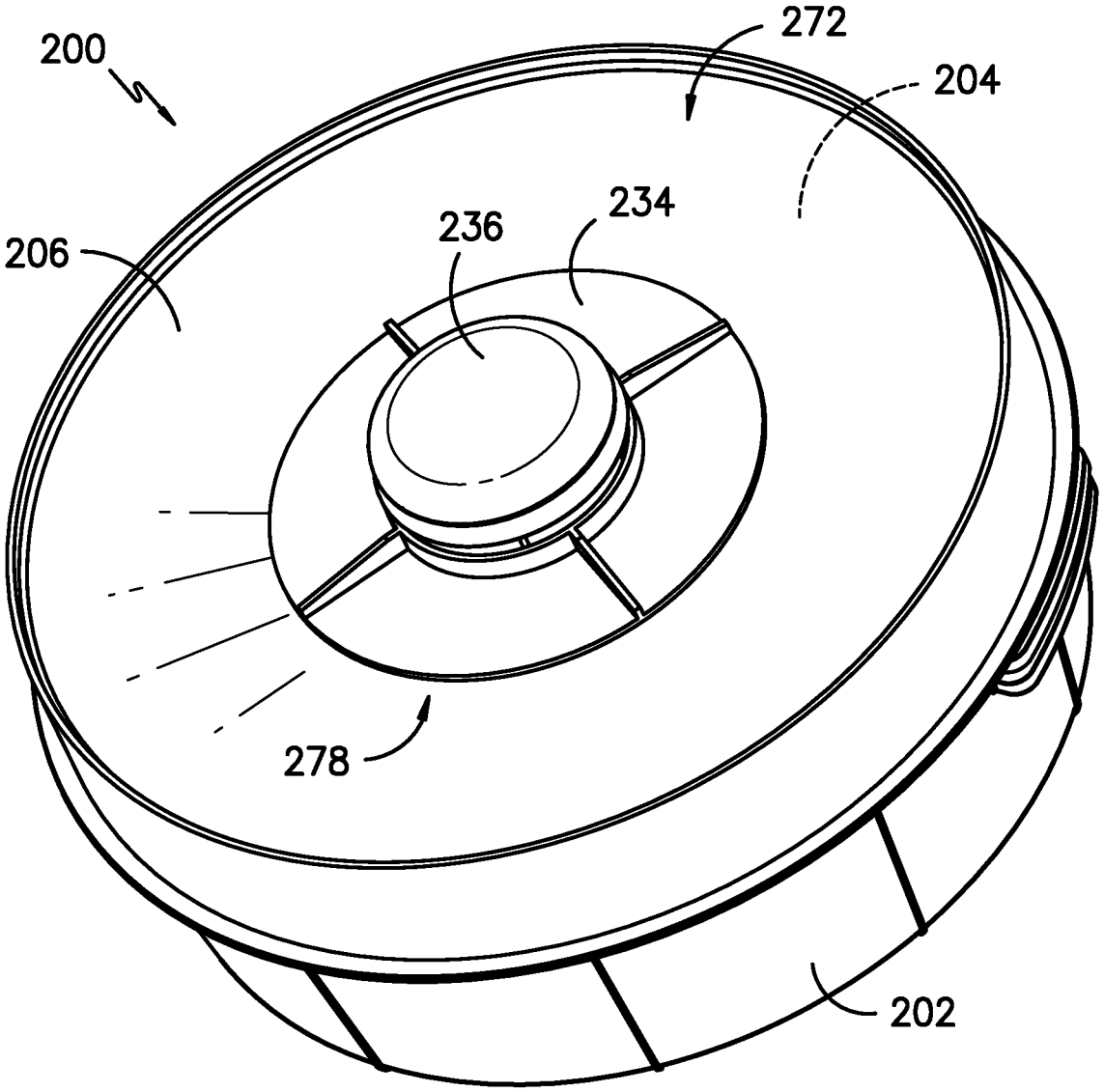
FIG. 4 if a perspective view of the exemplary wash basket assembly depicted in FIGS. 1 through 3.
Figure 5:
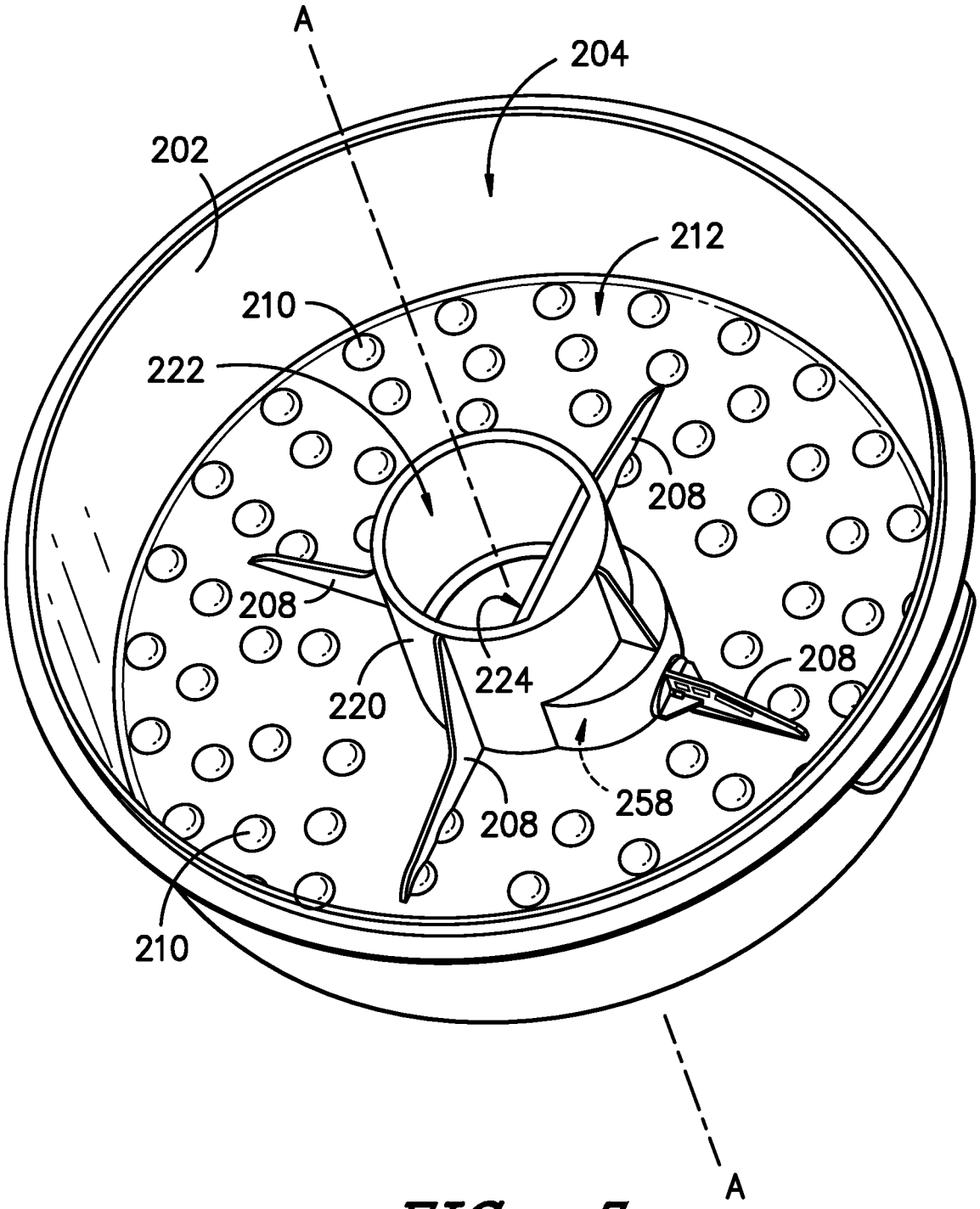
FIG. 5 is another perspective view of the exemplary wash basket assembly of FIG. 4 with a lid removed for purposes of illustration.

An exemplary embodiment of wash basket assembly 200 is shown in the figures where FIGS. 1 and 2 depict assembly 200 within washing appliance 100 while the FIGS. 3-10 provide various views of assemblies and components thereof. Referring to FIGS. 3, 4, and 5, wash basket assembly 200 includes a wash basket 202 (or "mini-wash basket") positioned on agitator 136 and defining a wash compartment 204. As will be described, wash basket 202 is detachable or removable from agitator 136 depending upon the cleaning cycle desired by the user. A lid 206 is removably positioned on wash basket 202 and encloses wash compartment 204.

As will be further described, wash basket assembly 200 allows a user to wash two loads of articles during a cleaning cycle of washing appliance 100—a first load can be placed in wash chamber 120 while a second load can be placed in wash compartment 204 and maintained separately from the first load during a cleaning cycle. Alternatively, the user can utilize only wash chamber 120 or only wash compartment 204 during a cleaning cycle of washing appliance 100 by placing articles to be cleaned only in one compartment or the other and selecting a corresponding cycle using control panel 138. This allows the user to wash, for example, a smaller load in wash basket 202 without utilizing the larger capacity of wash drum 122. Conversely, the user may utilize only the larger capacity of wash drum 122 and completely omit use of wash basket assembly 200 during a cleaning cycle if so desired. Controller 146 will operate one or more valves to dispense fluid from one or more dispensers, including dispenser 124, as may be required by the particular cleaning cycle selected by the user.

As shown in FIGS. 1 and 2, wash basket assembly 200 is removably received in wash chamber 120, which allows the user to insert or remove assembly 200 depending upon whether the user intends to wash articles in wash compartment 204. Wash basket assembly 200 can be removed from appliance 100 by lifting in the direction of arrow R along axis of rotation A-A of agitator 136 as depicted in FIG. 3. Alternatively, wash basket assembly 200 can be lowered onto agitator 136 in the direction of arrow K along axis of rotation A-A. Because wash basket assembly 200 is carried upon agitator 136, assembly 200 moves with agitator 136 during a cleaning cycle—thereby subjecting articles in wash compartment 204 to the actions of agitator 136. Vanes 208 and/or protrusions 210 on interior surface 212 can be provided in wash compartment 204 to assist in agitating articles during a cleaning cycle.

Figure 6:
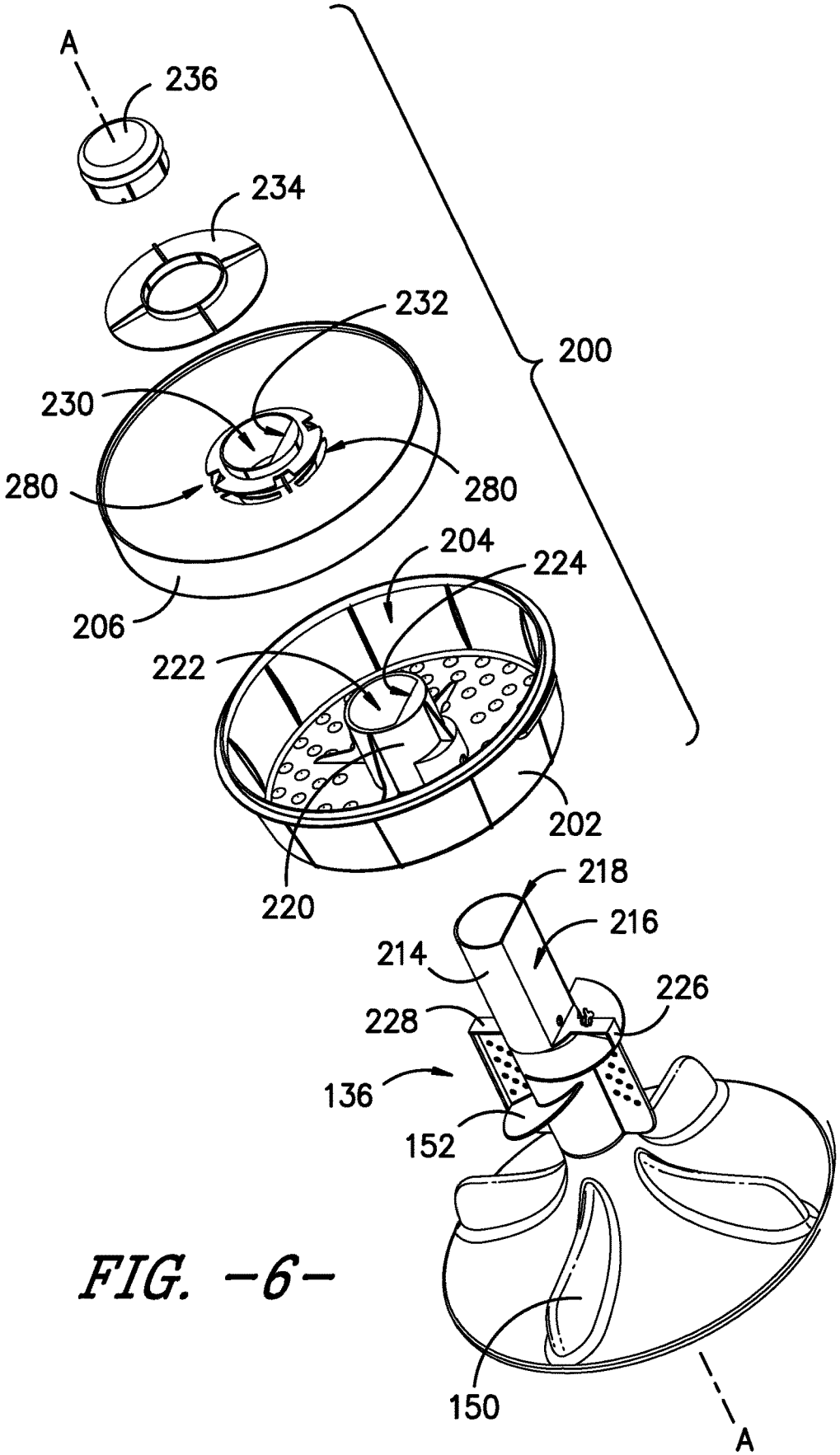
FIG. 6 is an exploded view of the exemplary wash basket assembly of FIG. 4 along with the exemplary agitator shown in FIGS. 1 through 3.
Figure 7:
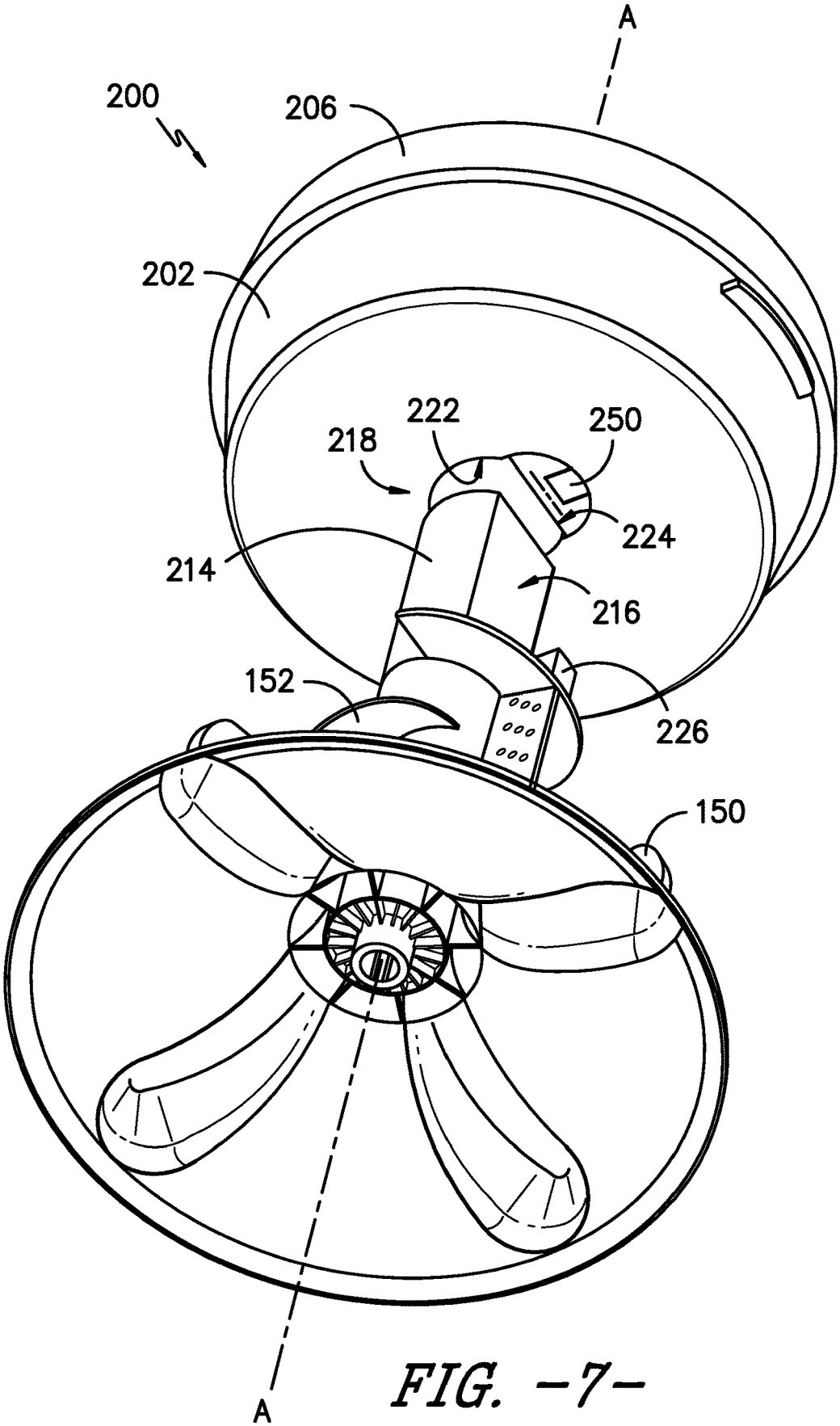
FIG. 7 is a bottom perspective view of the exemplary agitator of FIG. 3.

Referring to FIGS. 5, 6, and 7, wash basket assembly 200 and agitator 136 are provided with certain complementary features for aligning and supporting assembly 200 and preventing its rotation relative to agitator 136 during the operation of washing appliance 100. As best shown in FIGS. 6 and 7, agitator 136 includes a cylindrical shaft 214 with a flat surface 216 extending along the axial direction A-A and on one side at the uppermost distal end 218. Wash basket 202 includes a centrally-located, cylindrical post 220 extending along axial direction A-A from interior surface 212 (FIG. 5). Cylindrical post 220 defines a central opening 222 that is configured for receipt of uppermost distal and 218 of agitator 136. More particularly, central opening 222 is also cylindrically-shaped except for a flat surface 224 extending along axial direction A-A on one side.

To install over agitator 136, wash basket 202 most be properly oriented so that flat surface 216 of wash basket 202 and flat surface 224 of agitator 136 face and contact each other as basket 202 is lowered onto agitator 136. These complementary features prevent rotation of wash basket 202 relative to agitator 136 during operation of appliance 100 and, instead, ensure the two move together when wash basket assembly 200 is installed.

Agitator 136 also defines a pair of opposing supports 226 and 228 (FIGS. 6 and 7) that each extend radially outward (perpendicular to axial direction A-A) from shaft 214 along opposing sides. Supports 226 and 228 each provide a horizontal top surface on which wash basket 202 can be removably positioned during operation of appliance 100. Other configurations for supporting wash basket assembly 200 upon agitator 136 may be used as well.

As shown in FIG. 6, lid 206 also includes a central opening 230 that is also configured for receipt of uppermost distal end 218 of agitator 136. More particularly, central opening 230 is also cylindrically-shaped except for a flat surface 232 extending along axial direction A-A on one side. To install over agitator 136, lid 206 most be properly oriented so that flat surface 232 of lid 206 and flat surface 224 of agitator 136 face and contact each other as lid 202 is lowered onto agitator 136, which prevents rotation of lid 206 relative to agitator 136 during operation of appliance 100 and ensures the two move together during a cleaning operation.

Figure 8:
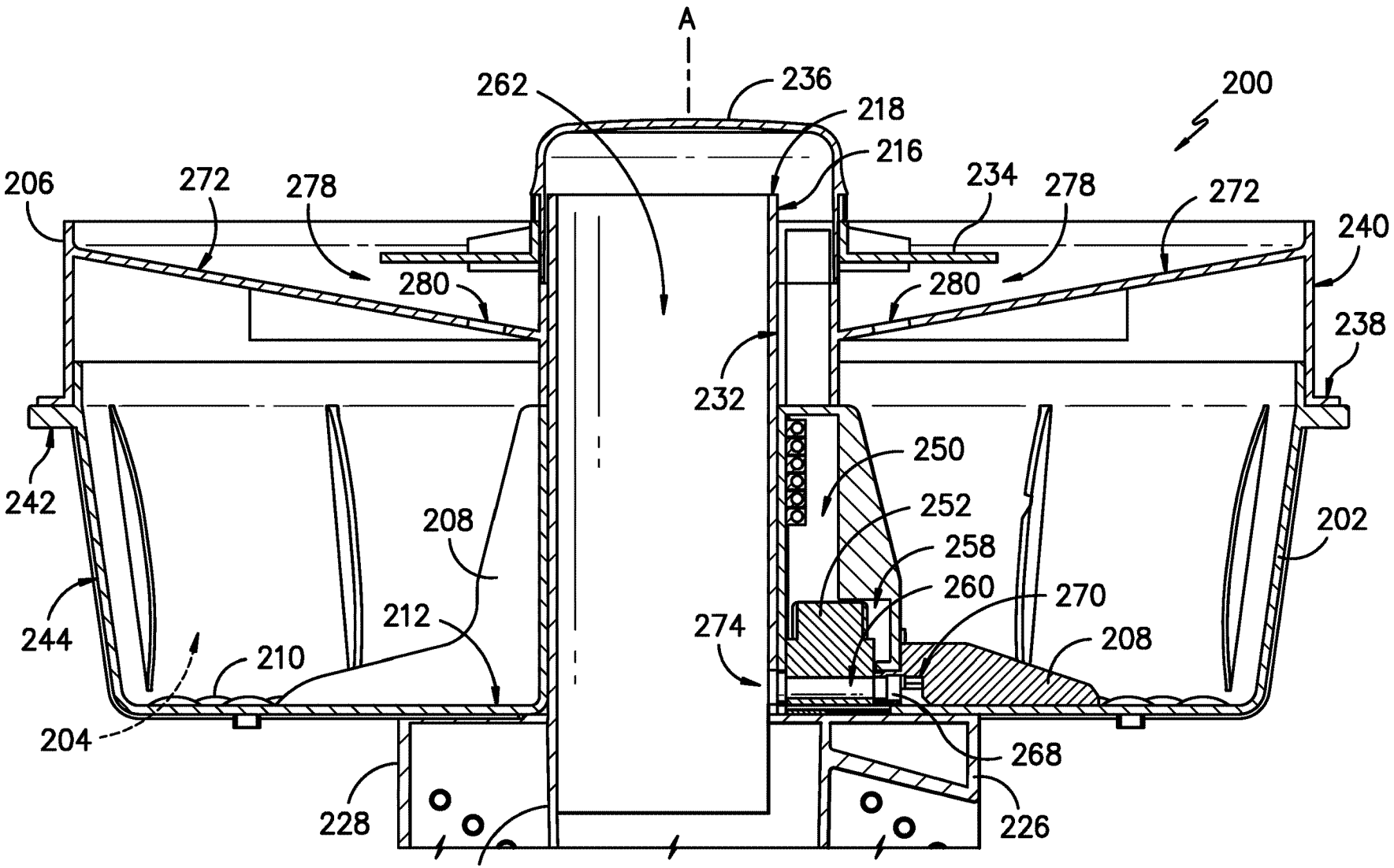
FIGS. 8 and 9 are cross-sectional views of the exemplary wash basket assembly of FIG. 4 positioned upon the exemplary agitator as in FIGS. 1 through 3, with FIG. 8 being a closer view at the top of the agitator.
Figure 9:
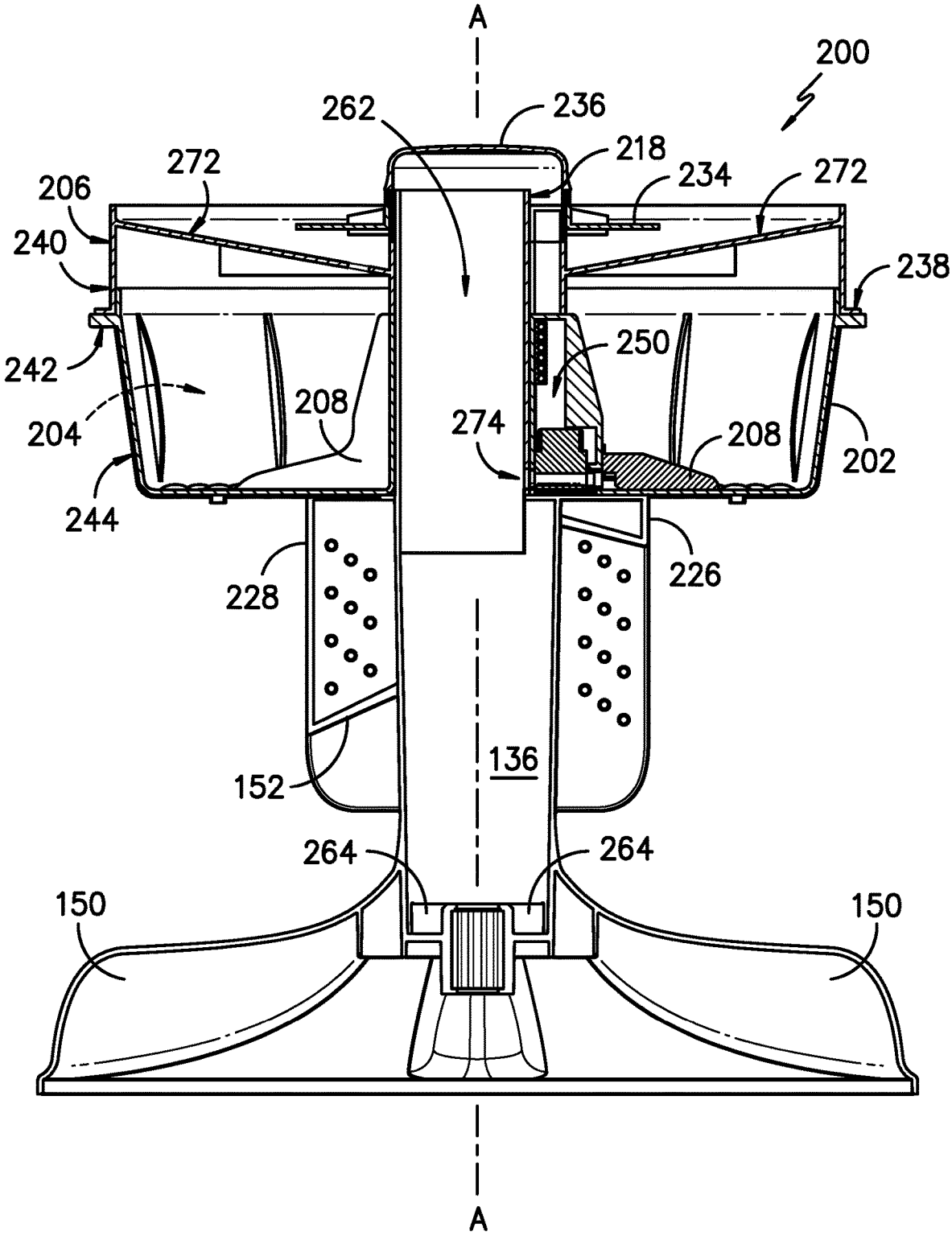

As best shown in FIGS. 8 and 9, lid 206 includes a lip 238 extending circumferentially around its outer cylindrical wall 240. Similarly, wash basket 202 defines a lip 242 extending circumferentially around outer cylindrical wall 244. Lip 238 is received in a complementary manner onto lip 242 such that wash basket 202 removably supports lid 206. A fluid retainer plate 234 is positioned over lid 206 and removably secured by a cap 236 that snaps into place to secure assembly 200.

Figure 10:
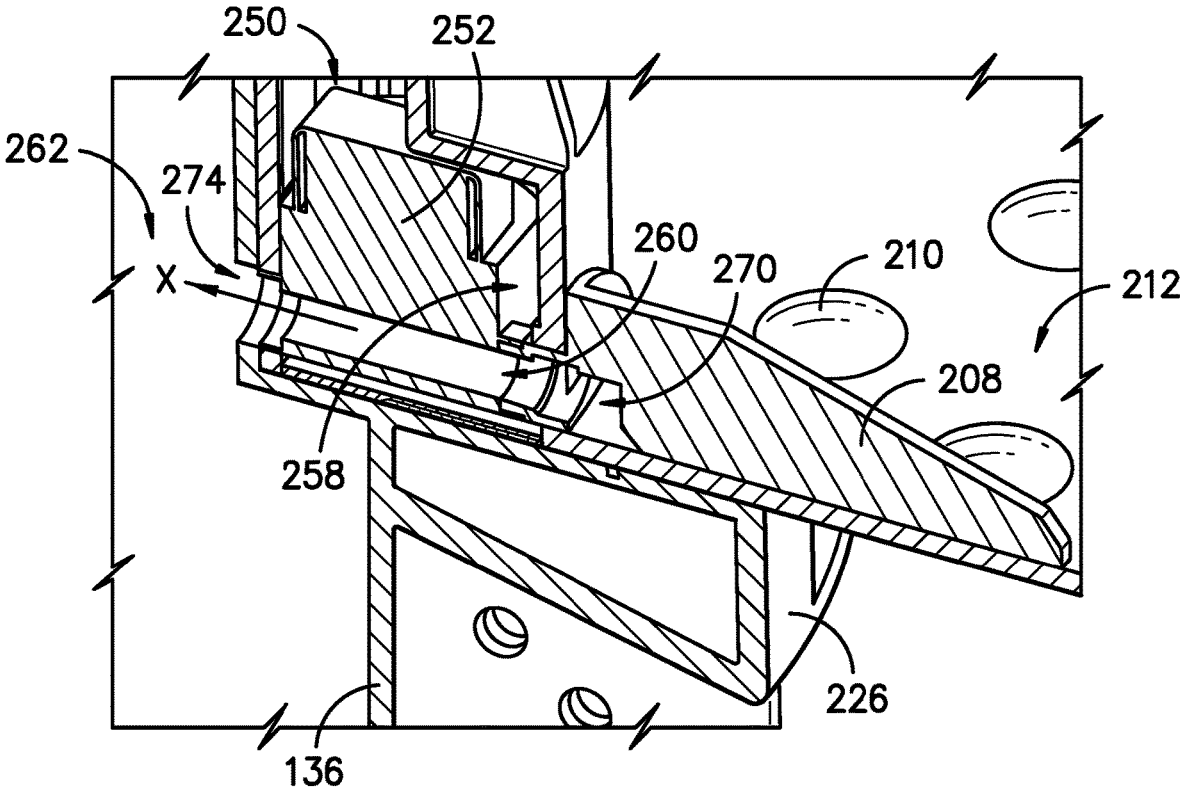
FIG. 10 is a partial cross-sectional view of a portion of the exemplary wash basket assembly of FIGS. 1 through 3 including an exemplary valve and related electronic module.
Figure 11:
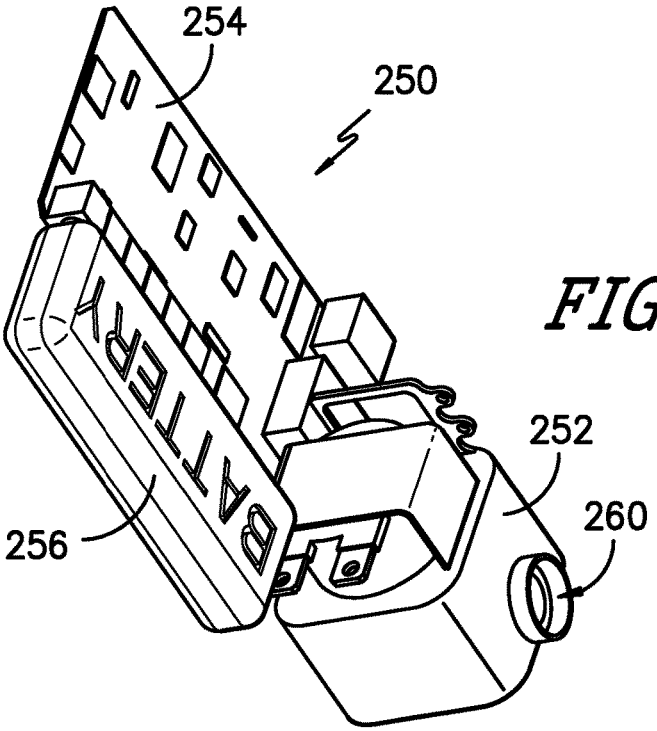
FIG. 11 is a perspective view of the exemplary valve and electronic module of FIG. 10.

Referring to FIGS. 7 through 11, washing appliance 100 includes a valve assembly 250 for draining fluid from wash compartment 204, through a drain 270 (FIG. 10) in wash basket 202, which in turn is connected with the interior fluid channel 262 of agitator 136 when assembly 200 is installed thereon. As best shown in FIG. 11, for this exemplary embodiment, valve assembly 250 include a solenoid valve 252 controlled by electronic module 254. More particularly, when valve 252 is in an open state, fluid in wash compartment 204 can be drained through drain 270 (arrow X in FIG. 10), through port 260 of valve 252, through a drain opening 274 defined by agitator 136 (FIGS. 8 and 10) and into interior fluid channel 262 of agitator 136. A rechargeable battery 256 provides power to operate valve 252 and electronic module 254, which is in communication with controller 146. For example, in one exemplary embodiment, module 254 and controller 146 may communicate through a Wi-Fi, Bluetooth, or other wireless connection. As such, controller 146 can operate to communicate with electronic module 254 and operate valve 252 according to a desired cleaning cycle selected by the user.

Figure 12:
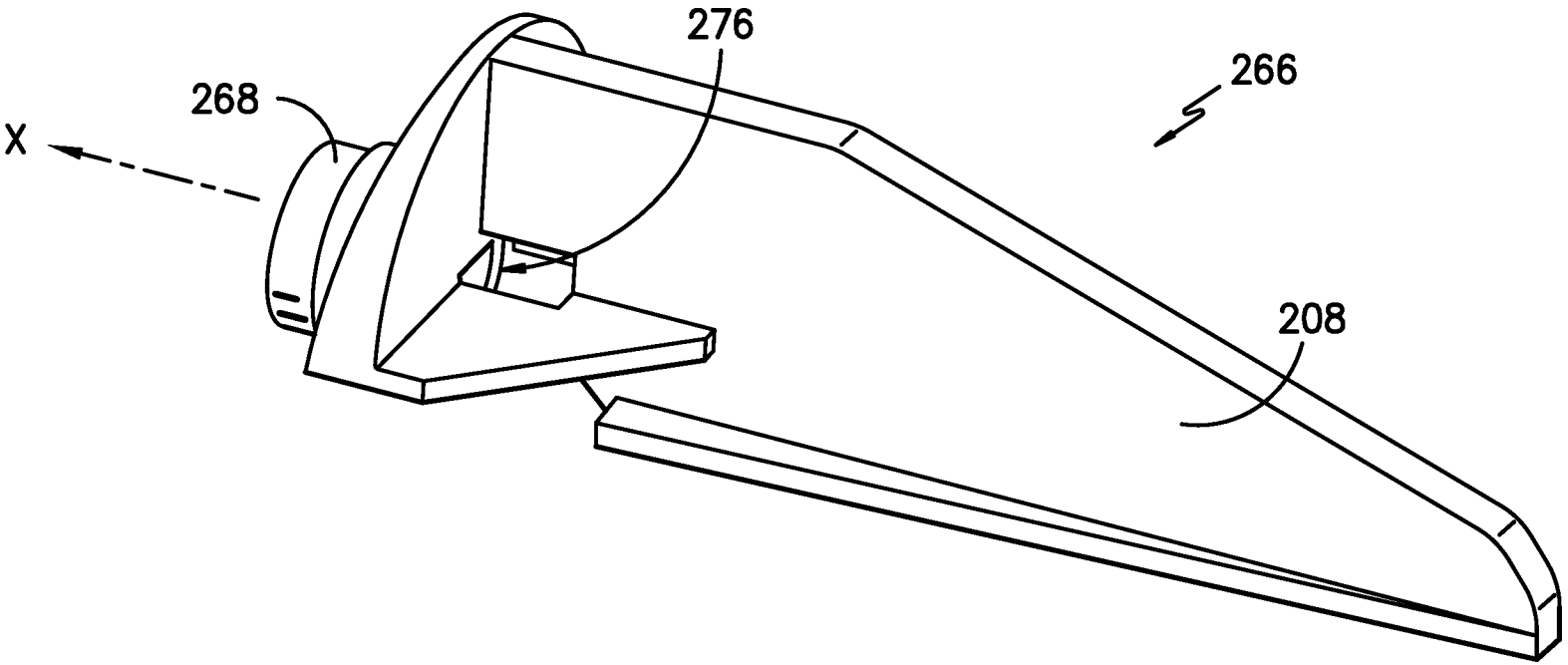
FIG. 12 is a perspective view of an exemplary plug of the present invention.

Referring to FIGS. 7 and 8, valve assembly 250 is installed by insertion along the axial direction A-A of electronic module 254 into a compartment 258 formed by agitator 136. Plug 266, which forms one of the vanes 208, secures module 254 into place. More particularly, as shown in FIG. 12, plug 266 includes a cylindrically shaped insert 268 forming a fluid channel 276 through which fluid flows (arrow X) when valve 252 is open. Insert 268 is received into port 260 of valve 252 to removably secure valve assembly 250 within compartment 258. Valve assembly 250 can be removed (e.g., for servicing or charging battery 256) by pulling plug 266 out of port 260 and then removing valve 250 from compartment 258.

An exemplary method of operating washing appliance 100 with wash basket assembly 200 will now be described. Using the teachings disclosed herein, one of ordinary skill in the art will understand that other methods may also be utilized. More particularly, an exemplary cleaning cycle may include loads in both wash basket 202 and wash drum 122, only in wash drum 122 (in which case wash basket assembly 200 may not even be placed onto agitator 136), or with a load of articles only in wash basket 202. All of these variations are within the scope of the invention as claimed.

For example, a user may elect to place a first load of articles into wash tub 118 and second load into wash compartment 204. The user may desire to wash both loads at the same time while keeping the articles separated during the cleaning cycle for various reasons including those mentioned previously. Alternatively, the user may elect to only place a smaller load into wash compartment 204 of wash basket assembly 200. Appliance 100 allows either option and the user selects the desired cleaning cycle using controller 146 and display 142, which in term provides one or more inputs to controller 146 that are used to operate appliance 100 accordingly. For purposes of illustration, a cleaning cycle where a load is placed only in wash basket 202 will be described.

The user may place wash basket 202 onto agitator 136, load articles into wash compartment 204, and then place lid 206 and cap 236 in place as previously described. Alternatively, the use may load wash basket 202 with articles, assembly lid and cap 236, and then place onto agitator 136.

Once the appropriate selection is made using control panel 138, controller 146 begins the cleaning cycle, which may include one or more wash, rinse, and or spin cycles as previously described. At various times during the cleaning cycle, a wash fluid may be introduced into wash compartment 204. Controller 146 causes one or more valves (e.g., a hot water valve, a cold water valve, or both) to be opened to allow wash fluid to flow from dispenser 124 as depicted by arrows T in FIGS. 1 and 2. Water retainer plate 234 and an inwardly sloped top surface 272 of lid 206 forms a slot 278 that extends circumferentially around agitator 136. As depicted by arrows I in FIG. 2, wash fluid can pass through slot 278, through one or more openings 280 in lid 206 (FIGS. 6 and 8), and into wash compartment 204. To facilitate the flow of fluid into openings 280, the top surface 272 of lid 206 is sloped towards central opening 230 or the shaft 214 of agitator 136. During operations of washing appliance 100, fluid retainer plate 234 precludes wash fluid from splashing out of wash compartment 204 through openings 280.

After a wash, spin, or rinse of a cleaning cycle, valve 252 can be opened to drain wash fluid from wash compartment 204 as depicted by arrow X in FIGS. 2, 10, and 12. Wash fluid escapes through drain 270 of wash basket 202 by passing through fluid channel 276 of plug 266, into port 260 of valve 252, through drain opening 274 of agitator 136, and into interior fluid channel 262. Referring to FIG. 2, wash fluid escapes agitator 136 through fluid outlets 264 of agitator 136 as depicted by arrows M and then passes to sump 134 as depicted by arrows W. Once wash fluid has drained from wash compartment 204, controller 146 can cause valve 252 to close. The user may remove cap 236, plate 234, and lid 206 to access the washed articles.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing appliance, comprising:

a cabinet;

a wash tub positioned in the cabinet and defining a wash chamber;

a wash drum rotatably mounted within the wash chamber and configured for receiving articles for washing;

an agitator rotatably mounted within the wash drum and extending into the wash chamber, the agitator defining an interior fluid channel for the flow of fluid towards a bottom of the wash tub;

a wash basket assembly comprising:

a wash basket removably positioned upon the agitator and defining a wash compartment configured for receiving articles for washing, the wash basket defining a drain connectable with the interior fluid channel of the agitator for draining fluid from the wash basket;

a valve for selectively controlling the flow of water from the wash compartment through the drain of the wash basket and into the interior fluid channel of the agitator; and a lid removably positioned on the wash basket and configured for enclosing the wash compartment, the lid defining at least one opening for passage of fluid into the wash compartment of the wash basket.

2. The washing appliance of claim 1, wherein the agitator includes at least one support upon which the wash basket can be removably positioned upon the agitator.

3. The washing appliance of claim 1, wherein the wash basket defines a central opening configured for receipt of an uppermost distal end of the agitator, and wherein the wash basket and the uppermost distal end of the agitator have complementary features to align the wash basket on the agitator and prevent rotation of the wash basket relative to the agitator during operation of the washing appliance.

4. The washing appliance of claim 1, further comprising at least one controller for operating the washing appliance, wherein the valve is electronically actuated and in wireless communication with the controller.

5. The washing appliance of claim 1, wherein the lid comprises an upper surface inwardly inclined so that fluid on a top surface of the lid can flow towards the agitator.

6. The washing appliance of claim 1, further comprising a fluid dispenser positioned above the wash drum and configured to supply fluid onto the lid.

7. The washing appliance of claim 1, further comprising at least two supports positioned in an opposing manner on the agitator and configured for supporting the wash basket.

8. The washing appliance of claim 1, wherein the wash basket assembly further comprises a fluid retainer plate removably positioned over the at least one opening of the wash basket to deter the splashing of fluid out of the wash basket through the at least one opening.

9. The washing appliance of claim 8, wherein the wash basket assembly further comprises a cap removably positioned over the lid and configured to secure the wash basket to the agitator during operation of the washing appliance.

10. The washing appliance of claim 8, wherein the agitator defines a fluid outlet for the flow of water from the interior fluid channel of the agitator.

11. The washing appliance of claim 1, further comprising at least one controller for operating the washing appliance, wherein based on input from a user of the appliance, the controller is configured to execute a cleaning cycle that supplies fluid only into the wash basket, only into the wash drum, or into both the wash basket and the wash drum.

12. A wash basket assembly for a washing appliance having an agitator that includes an interior fluid channel for the flow of fluid through a center of the agitator towards a bottom of the wash tub and also having a controller, the wash basket assembly comprising:

a wash basket for removably positioning upon the agitator, the wash basket defining a wash compartment configured for receiving articles for washing, the wash basket defining a drain positioned near the agitator for allowing fluid to flow out of the wash basket into the interior fluid channel of the agitator;

a valve for selectively controlling the flow of water from the wash compartment of the agitator through the drain and into the interior fluid channel of the agitator; and a lid removably positioned on the wash basket and configured for enclosing the wash compartment, the lid defining at least one opening for passage of fluid into the wash compartment of the wash basket.

13. The wash basket assembly of claim 12, further comprising an electronic module for controlling the valve and communicating with the controller of the washing appliance.

14. The wash basket assembly of claim 13, wherein the wash basket defines a compartment for receipt of the valve and the electronic module.

15. The wash basket assembly of claim 14, further comprising a plug located in the wash compartment and positioned at the drain, the plug defining a fluid channel for the flow of water to the agitator, the plug also defining an insert that is received by the valve to secure the valve in the compartment.

16. The wash basket assembly of claim 15, wherein the lid defines a top surface sloped towards one or more openings for the passage of fluid into the wash compartment.

17. The wash basket assembly of claim 16, further comprising a fluid retainer plate positioned over the lid, and wherein the top surface of the lid and the retainer plate define a slot for the passage of water to the one or more openings.

18. The wash basket assembly of claim 16, wherein the wash basket defines a central opening for receipt of the agitator.

* * * * *